United States Patent [19]

Rainger et al.

[11] Patent Number: 4,740,254

[45] **Date of Patent: * Apr. 26, 1988**

[54] PITTING RESISTANT DUPLEX STAINLESS STEEL ALLOY

[75] Inventors: Charles W. Rainger, Huron; Allan P. Castillo, Castalia; John C. Rogers, Sandusky, all of Ohio

[73] Assignee: Sandusky Foundry & Machine Co., Sandusky, Ohio

[ * ] Notice: The portion of the term of this patent subsequent to Sep. 16, 2003 has been disclaimed.

[21] Appl. No.: 902,416

[22] Filed: Aug. 29, 1986

Related U.S. Application Data

[63] Continuation-in-part of Ser. No. 637,892, Aug. 6, 1984, Pat. No. 4,612,069.

[51] Int. Cl.[4] ..... C22C 38/42

[52] U.S. Cl. ..... 148/325; 148/327; 420/60; 420/61; 420/58

[58] Field of Search ..... 148/325, 327; 420/60, 420/61, 56–58

[56] References Cited

U.S. PATENT DOCUMENTS

| | | | |
|---|---|---|---|
| 3,082,082 | 3/1963 | Bidwell | 420/61 |
| 3,567,434 | 3/1971 | Richardson et al. | 420/61 |
| 4,172,716 | 10/1979 | Abo | 420/60 |
| 4,218,268 | 8/1980 | Hiraishi et al. | 148/325 |
| 4,224,061 | 9/1980 | Hiraishi et al. | 148/325 |
| 4,391,635 | 7/1983 | Murakami et al. | 420/61 |
| 4,612,069 | 9/1986 | Rainger et al. | 148/325 |

FOREIGN PATENT DOCUMENTS

| | | | |
|---|---|---|---|
| 55-44528 | 3/1980 | Japan | 148/325 |
| 55-158256 | 12/1980 | Japan | 148/325 |
| 57-47852 | 3/1982 | Japan | 148/325 |

OTHER PUBLICATIONS

Keyser, A. Carl, Materials Science in Engineering, "Metal Fabrication and its Effects on Properties", p. 223, 2nd Ed., 1980.

*Primary Examiner*—Deborah Yee

*Attorney, Agent, or Firm*—Emch, Schaffer, Schaub & Porcello Co.

[57] ABSTRACT

A highly pitting resistant duplex stainless steel alloy is provided which comprises, in weight percentage, C: 0.10% and below; Si: 1.5% and below; Mn: 2.0% and below; Cr: 25.0% to 27.0%; Ni: 5.0% to 7.5%; Cu: 1.5% to 3.5%; N: 0.15% and below; Mo: 0.5% and below; and the remaining portion being substantially Fe to form the material of the highly pitting resistant duplex stainless steel alloy.

2 Claims, 7 Drawing Sheets

PITTING RESISTANCE TEST RESULTS OF

VERY SLOWLY CONTROL-COOLED MATERIALS

| Alloy | Breakdown Potential Millivolts Versus SCE[1] |
|---|---|
| X-6; 3.2% Cu | +239 |
| X-6; 2.0% Cu | +184 |
| Modified Alloy 75 with 0.8% Cu | Ø |
| Alloy 75 | Ø |
| Modified X-6 with 2.1% Cu + 1.1% Mo | Ø |

---

Simulated Paper Mill
Acid White Water
Environment 400 ppm[2] . . . $Cl^-$ (Chloride)

35 ppm . . . $S_2O_3^=$ (Thiosulfate)

800 ppm . . . $SO_4^=$ (Sulfate)

pH = 4.1

Temp. = 130°F

[1] SCE = Standard Calomel Electrode

[2] ppm = parts per million

FIG. 1

Chemical Composition (Weight Percent)

| Alloy | Heat Number | C | Cr | Ni | Mn | Si | P | S | Mo | N | Cu |
|---|---|---|---|---|---|---|---|---|---|---|---|
| X-6 | 1232-3 | 0.021 | 25.27 | 7.08 | 0.62 | 0.91 | 0.027 | 0.012 | 0.11 | 0.07 | 2.03 |
| CF-3M | 168375 | 0.013 | 17.70 | 14.92 | 1.01 | 0.82 | 0.041 | 0.009 | 2.24 | 0.062 | 0.36 |
| Alloy 75 | 167295 | 0.017 | 25.22 | 6.59 | 0.54 | 0.62 | 0.030 | 0.004 | 0.07 | 0.067 | 0.14 |
| Alloy 75 | 161353 | 0.024 | 26.32 | 7.02 | 0.75 | 0.63 | 0.033 | 0.011 | 0.03 | 0.091 | 0.25 |
| Alloy 75 | 161255 | 0.014 | 25.53 | 6.64 | 0.73 | 0.65 | 0.022 | 0.003 | 0.02 | 0.066 | 0.09 |

| Alloy | Heat Number | 0.2% OFFSET Yield Strength (ksi) | Ultimate Tensile Strength (ksi) | % Elongation in 2.0 in.[1] | % Reduction in Area | BHN |
|---|---|---|---|---|---|---|
| X-6 | 1232-3 | 53.1 | 112.0 | 26.0 | 28.5 | 229 |
| CF-3M | 168375 | 28.8 | 72.8 | 54.0 | 51.0 | --- |
| Alloy 75 | 167095 | 58.8 | 112.5 | 22.0 | 18.0 | 235 |
| Alloy 75 | 161353 | 62.4 | 119.0 | 16.0 | 15.0 | 242 |
| Alloy 75 | 161255 | 59.7 | 108.6 | 27.5 | 51.0 | 229 |

1 ASTM Designation : A370 - 77

FIG. 5

Summary of Chemical Analyses of Experimental Castings of Modified Alloy X-6

| Item No. | Ladle Identification | Chemical Analyses (wt. %) | | | | | | | | |
|---|---|---|---|---|---|---|---|---|---|---|
| | | C | Mn | Si | Cr | Ni | Cu | N | P | S |
| 1 | 1331-L1 | 0.027 | 0.63 | 0.97 | 25.30 | 7.44 | 2.95 | 0.057 | 0.027 | 0.018 |
| 2 | 1331-L2 | 0.027 | 0.67 | 1.59 | 25.17 | 7.34 | 2.91 | 0.062 | 0.026 | 0.018 |
| 3 | 1327-L1 | 0.017 | 1.46 | 0.63 | 25.09 | 7.23 | 2.76 | 0.074 | 0.025 | 0.020 |
| 4 | 1327-L2 | 0.018 | 1.96 | 0.62 | 25.09 | 7.30 | 2.75 | 0.077 | 0.024 | 0.022 |
| 5 | 1327-L3 | 0.025 | 2.59 | 0.57 | 25.21 | 7.62 | 2.73 | 0.073 | 0.043 | 0.017 |
| 6 | 1328-L1 | 0.049 | 0.68 | 0.44 | 24.74 | 7.10 | 3.00 | 0.072 | 0.027 | 0.020 |
| 7 | 1328-L2 | 0.075 | 0.61 | 0.43 | 24.63 | 6.77 | 2.98 | 0.068 | 0.026 | 0.020 |
| 8 | 1331-L3 | 0.080 | 1.78 | 1.52 | 25.23 | 7.20 | 2.88 | 0.064 | 0.027 | 0.018 |
| 9 | 1328-L3 | 0.099 | 0.57 | 0.41 | 24.87 | 6.89 | 2.99 | 0.074 | 0.026 | 0.017 |

Note: Actual molybdenum ladle analyses for Items 1-9 were less than 0.01%.

FIG. 6

Mechanical Properties Data [1]

of Experimental Castings of Modified X-6 Alloy

| Cross Reference | Elemental Modification To Alloy X-6 | 0.2% Offset Yield Strength psi | Tensile Strength psi | % Elongation in 2 inches |
|---|---|---|---|---|
| Figure 6 - Item 1 | Si to 0.97% | 53,650 | 99,000 | 9 |
| " - " 2 | " " 1.59% | 55,325 | 84,750 | 1 |
| " - " 3 | Mn " 1.46% | 52,050 | 106,525 | 31 |
| " - " 4 | " " 1.96% | 52,425 | 106,125 | 31 |
| " - " 5 | " " 2.59% | 50,375 | 70,025 | 2 |
| " - " 6 | C " 0.049% | 50,300 | 103,125 | 29 |
| " - " 7 | " " 0.075% | 46,600 | 98,550 | 19 |
| " - " 8 | Si " 1.52%<br>Mn " 1.78%<br>C " 0.08% | 53,450 | 69,275 | 1 |
| " - " 9 | C " 0.099% | 44,150 | 87,150 | 12 |

[1] Average of two tests

FIG. 7

PITTING RESISTANT DUPLEX STAINLESS STEEL ALLOY

BACKGROUND OF THE INVENTION

The present invention is a continuation-in-part of the co-pending patent application, Ser. No. 637,892, filed Aug. 6, 1984, now U.S. Pat. No. 4,612,069.

The present invention relates to a duplex stainless steel alloy composition, and more particularly to a copper-bearing duplex stainless steel alloy composition, which has exceptional pitting resistance.

The alloy of the present invention has useful applications in the chemical and pulp and paper manufacturing industries. The alloy can be used in such applications as vessels, retorts and piping; for paper machine roll shells such as coater rolls, grooved rolls and blind-drilled rolls; and for paper machine suction roll applications such as breast rolls, couch rolls, pickup rolls, press rolls and wringer rolls.

The use of copper in austenitic stainless steels, such as Carpenter Alloy 20 and CN-7M, and in duplex stainless steels, such as CD-4MCu (U.S. Pat. No. 3,082,082) and Ferralium ®Alloy 255 (U.S. Pat. No. 3,567,434) is well known. The CD-4MCu and Ferralium ®Alloy 255 alloys are duplex stainless steels that were developed as casting alloys and contain about equal amounts of austenite and ferrite. Duplex stainless steels have certain advantages over the fully austenitic stainless steels, such as much higher yield and tensile strengths, and reduced susceptibility to sensitization, intergranular corrosion and intergranular stress corrosion cracking. Alloy 75 was developed by Sandusky Foundry and Machine Company for suction roll shell applications to take advantage of these attributes.

The CD-4MCu alloy and the Ferralium ®255 alloy have some similarities to the Alloy 75 composition. The nominal chemical compositions of the three alloys are as follows:

| | Chemical Composition (Wt. Percent) | | | | | |
|---|---|---|---|---|---|---|
| Alloy | C | Cr | Ni | Mo | Cu | N |
| CD-4MCu | 0.04 | 25.5 | 5.5 | 2.0 | 3.0 | — |
| Ferralium ® Alloy 255 | 0.04 | 25.5 | 5.5 | 3.0 | 1.7 | 0.17 |
| Alloy 75 | 0.02 | 25.7 | 6.8 | — | — | 0.07 |

While CD-4MCu and Ferralium ®Alloy 255 are very similar, one significant difference is that Ferralium-®Alloy 255 contains an intentionally high nitrogen addition. In both the CD-4MCu and Ferralium ® alloys, copper is added to contribute precipitation hardening capabilities. An aging treatment at 480° C. for two hours will increase yield and tensile strengths about 15–20%, but that aging treatment is no longer recommended for the CD-4MCu alloy. Also, CD-4MCu and Ferralium ®Alloy 255 both contain 2% or more molybdenum, while Alloy 75 contains negligible molybdenum.

The addition of molybdenum improves the pitting resistance of stainless steels in chloride-containing environments. The beneficial effect of molybdenum for pitting resistance and crevice corrosion resistance in stainless steels may be predicted with an empirical pitting index that is based upon chemical composition. The pitting index is determined by adding the chromium content plus three to four times the molybdenum content. The higher the pitting index value, the better the pitting resistance.

Molybdenum, being a strong ferrite promoter, tends to concentrate in the ferrite phase in duplex stainless steels; therefore, the austenite phase may contain less than half the molybdenum content of the ferrite. Molybdenum also fosters the formation of sigma and chi phases within the ferrite during slow cooling through, or exposure in, the temperature range from about 650°–870° C. Molybdenum also promotes the formation of the alpha prime phase and another unnamed iron-chromium compound in the ferrite in the temperature range from about 370°–540° C. Sigma, chi and alpha prime phases, and the unnamed iron-chromium compound reduce very significantly the ductility and toughness of stainless steel. Thus, to obtain good mechanical properties, molybdenum-containing duplex stainless steels must be rapidly cooled from the solution annealing temperature. Although rapid cooling avoids embrittlement of molybdenum-containing stainless steels, it also creates a new problem by producing undesirably high levels of tensile residual stresses in the materials.

These residual stresses are a concern to the entire metallurgy industry because they are locked-in stresses which are present in a part which is not subjected to an external load. In a suction roll shell, the applied stress and a significant percentage of the tensile residual stress add up to produce a higher total stress. Such residual stresses result from nonuniform cooling of different parts of the castings after any thermal processing step, and heat treatment is an example of thermal processing. For a suction roll shell, nonuniform cooling can occur through the section thickness, along its length or even between the inside and the outside surfaces. The magnitude of cooling nonuniformity and therefore tensile residual stress is greatest at the fastest cooling rates, that is, water-quenching, and lowest at the slowest cooling rates, that is, very slow control-cooling in a tightly closed heat-treat furnace.

High tensile residual stresses are very detrimental to the service performance of suction roll shells employed in papermaking machines. The molybdenum-bearing duplex stainless steels, such as Alloy A171, Alloy 63, CD-4MCu and Ferralium ®Alloy 255, which must be rapidly cooled from the solution-annealing temperature, will have very high levels of tensile residual stresses and, therefore, poor service performance.

For example, a prior art duplex material, Alloy 63, nominally consisting of (in weight percentages); C: 0.05%; Si: 1.3% Mn: 0.8%; Cr: 21.8%; Ni: 9.4% Mo: 2.7%; and the remaining portion Fe and unavoidable impurities has exceptional corrosion resistance and very high corrosion-fatigue strength but has given poor service in paper machines. Approximately 34% of Alloy 63 suction roll shells have unacceptable, early failures attributed to high levels of tensile residual stresses. The high levels of tensile residual stresses result from a solution-anneal water-quench heat treatment commonly used by makers of cast stainless steels to produce materials which have acceptable ductility and corrosion resistance.

Another prior art suction roll shell material, A171, nominally consists of (in weight percentages); C: 0.06%; Si: 1.5%; Mn: 0.8%; Cr: 23.0%; Ni: 8.3%; and Mo: 1.2%. Alloy A171 also experienced premature failures which are attributable to high levels of tensile residual stresses that result from a solution-anneal water-quench heat treatment.

If prior art materials Alloy 63 and A171 are given a very slow control-cool heat treatment from the solution annealing temperature of 980°-1090° C., the ferrite in the alloy transforms to the brittle sigma and/or chi phases during the long period of time the alloy spends in the temperature range of about 650°-870° C. and two other brittle phases, alpha prime and another unnamed iron-chromium compound in the temperature range of about 370°-540° C. As a result, the ductility of Alloy 63 and A171 are severely reduced to unacceptably low values as measured by percent elongation in a uniaxial tension test. The embrittlement is demonstrated by a comparison of uniaxial tension test results of Alloy 63 in the solution-annealed and water-quenched condition to Alloy 63 in the very slowly control-cooled condition. Percent elongation was reduced from 39% in the solution-annealed and water-quenched condition to 2% in the very slowly control-cooled condition. This embrittlement is promoted in duplex stainless steels which contain molybdenum such as Alloy 63 and A171.

Examination of the cited chemical analysis of prior art Hiraishi et al. U.S. Pat. Nos. 4,218,268 and 4,224,061 materials and knowledge of the temperature ranges through which these materials must be cooled indicates that the Hiraishi et al. '268 and '061 materials are also embrittled by a slow cooling process.

Prior art Alloy 75 was developed as a material having acceptable corrosion and ductility properties when very slowly control-cooled and consists nominally of (in weight percentages); C: 0.02%; Si: 0.5%; Mn: 0.8%; Cr: 25.7%; Ni: 6.8%; N: 0.07%; and the remaining portion Fe and unavoidable impurities. In contrast to the molybdenum-containing duplex stainless steels, Alloy 75 can be very slowly furnace control-cooled from a high temperature without fear of excessive formation of brittle phases. In addition, very slow control-cooling results in a very low level of residual stress.

Although furnace cooling of Alloy 75 shells has lead to very low levels of residual stress and good service performance, Alloy 75 lacks the pitting resistance of the molybdenum-bearing stainless steels in highly corrosive environments. In most paper mill white waters, Alloy 75 has adequate pitting resistance. However, Alloy 75 can pit when corrosive conditions become very severe. For instance, when mills close up the white water system, the chloride and thiosulfate ion concentrations increase resulting in a more corrosive environment.

Pitting of Alloy 75 roll shells has occurred in paper mill service in environments containing high levels of the chloride and thiosulfate ions. Alloy 75 has also been found to pit in laboratory tests in similar environments. Pitting has been found to initiate in the austenite and at austenite/ferrite interfaces. Pit initiation in the ferrite phase has not been detected. Energy dispersive X-ray analysis has shown that the chemical composition of the ferrite and austenite in Alloy 75 is about as follows:

| | Chemical Composition, percent | |
|---|---|---|
| | Cr | Ni |
| Austenite | 22 | 10 |
| Ferrite | 31 | 5 |

The relatively low chromium content of the austenite phase is believed to be responsible for its reduced pitting resistance.

In summary, molybdenum has traditionally been added to prior art alloys in order to increase their pitting corrosion resistance to corrosive environments containing chlorides. Examples of prior art duplex stainless steels using molybdenum are Alloy 63, A171, Ferralium 255, CD4MCU and Hiraishi et al. '061 and '268 alloys. These prior art steels require at least one heat treatment step of solution annealing at approximately 900°-1150° C. followed by a fast cooling step in order to avoid undesirable formation of embrittling phases. It is known that the fast cooling step induces harmful tensile residual stresses in conventional stainless steel castings. Prior art Alloy 75, developed to contain negligible molybdenum and to have low tensile residual stresses, lack sufficient pitting resistance in severely corrosive white water environments.

Accordingly, an essential object of the invention is to improve the pitting resistance of duplex stainless steels.

The objectives and advantages of the invention will be apparent to those skilled in the art from a reading of the present specification and claims.

SUMMARY OF THE INVENTION

The present invention concerns an improved duplex stainless steel alloy useful for suction roll shells and having improved pitting resistance properties which are obtained by adding an effective amount of copper to the alloy while not intentionally adding molybdenum.

The present invention provides a highly pitting resistant ferritic-austenitic duplex cast stainless steel alloy which has been very slowly control-cooled such that harmful tensile residual stresses are minimized while retaining excellent ductility and corrosion resistance, which comprises, in weight percentage, C: 0.10% and below; Si: 1.5% and below; Mn: 2.0% and below; Cr: 25.0% to 27.0%; Ni: 5.0% to 7.5%; Cu: 1.5% to 3.5%; N: 0.15% and below; Mo: 0.5% and below; and the remaining portion being substantially Fe to form the material of the highly pitting resistant duplex stainless steel alloy.

DESCRIPTION OF THE FIGURES

FIG. 1 is a table showing the pitting resistance test results of various very slowly control-cooled materials.

FIG. 5 is a table showing the chemistry and mechanical property data comparing the X-6 alloy to prior art alloys.

FIG. 6 is a table showing the chemical analyses of experimentally modified X-6 alloys with variations in carbon, manganese and silicon contents.

FIG. 7 is a table showing the mechanical properties for experimentally modified X-6 alloys with variations in carbon, manganese and silicon contents.

DESCRIPTION OF THE PREFERRED EMBODIMENTS

Figure 2:
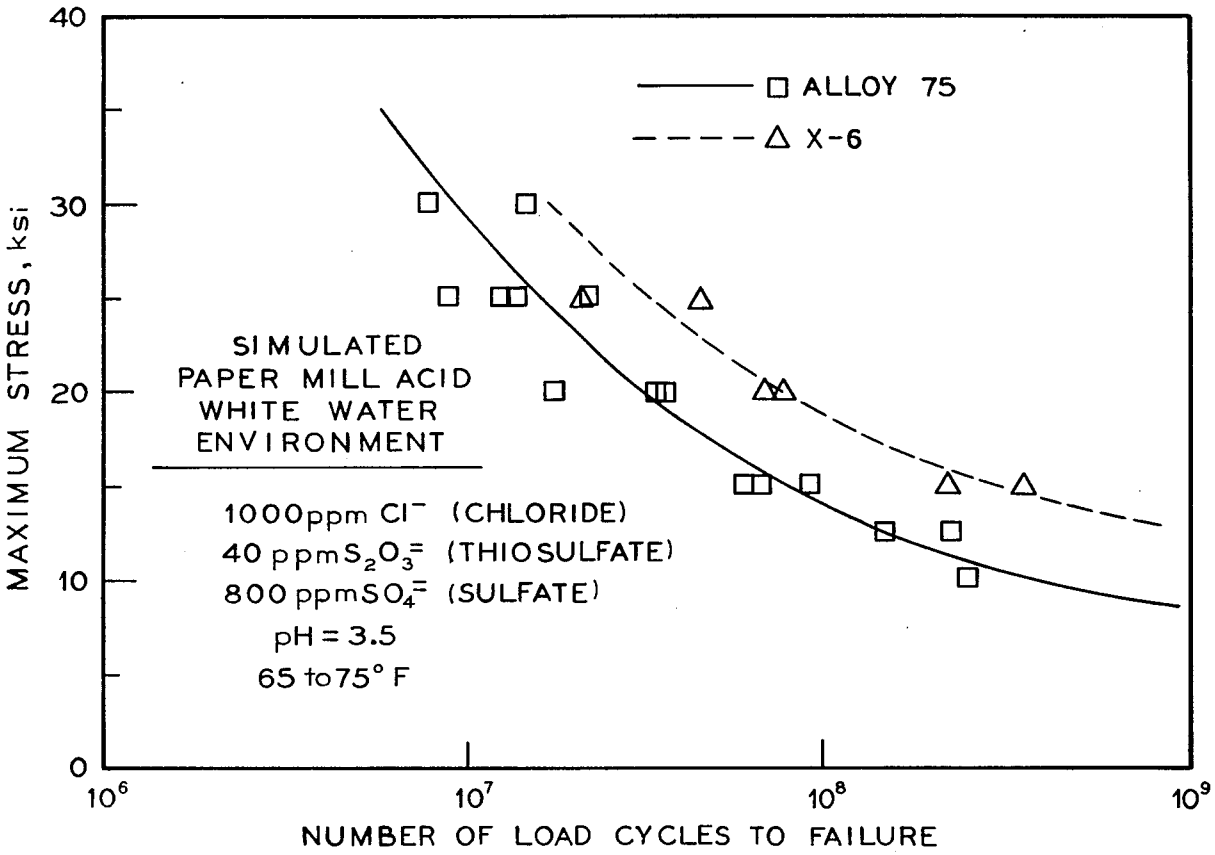
FIG. 2 is a graph showing improved corrosion-fatigue behavior of the X-6 alloy as compared to the prior art alloy 75.

In particular, the invention relates to duplex stainless steel alloys for use in manufacturing a suction roll shell having improved pitting resistance, better corrosion-fatigue resistance, and low tensile residual stresses. The present invention (X-6) is directed to a highly pitting and corrosion-fatigue resistant ferritic-austenitic cast duplex stainless steel which has been very slowly control-cooled in order to minimize harmful tensile residual stresses while retaining excellent ductility and corrosion resistance, and consists of (in weight percentages); C: 0.10% and below; Si: 1.5% and below; Mn: 2.0% and below; Cr: 25.0% to 27.0%; Ni: 5.0% to 7.5%; Cu: 1.5% to 3.5%; N: 0.15% and below; Mo: 0.5% and below; and the remaining portion Fe and unavoidable impurities.

The alloy of the present invention is unique and has unexpected properties not found in conventional alloys. The alloy has high pitting resistance, excellent ductility and minimal tensile residual stresses. The alloy of the present invention does not require either a solution-anneal water-quench heat-treat step or addition of molybdenum as an alloying element in order to achieve its desirable properties.

The alloy of the present invention contains an intentional 1.5% to 3.5% addition of copper to improve pitting corrosion resistance and corrosion-fatigue resistance. These improvements can be made while maintaining excellent ductility of about 17%; maintaining minimal tensile residual stresses by using a very slow control-cool heat treatment; and yet avoiding the traditional addition of molybdenum to increase pitting corrosion resistance.

If less than 1.5% copper is present in the alloy of the present invention, the pitting resistance of the alloy decreases to that of the prior art Alloy 75. FIG. 1 is a table showing a comparison of pitting resistance as measured by breakdown potential in electrochemical polarization tests of two X-6 alloy materials to prior art Alloy 75, a modified Alloy 75 material containing 0.8% copper, and one modified X-6 material containing 1.10% Mo. The pitting resistance of the alloys of the present invention containing 2.0% and 3.2% copper is considered excellent because their breakdown potentials are greater than +150 millivolts. Poor pitting resistance is demonstrated in prior art Alloy 75, the modified Alloy 75 with 0.8% copper, and modified X-6 material containing 1.10% Mo because their breakdown potentials are zero. If more than 3.5% copper is present, the preferred austenite-ferrite balance of the claimed alloy's microstructure is upset because an excess amount of austenite is present.

The copper addition improves the pitting resistance of the alloy of the present invention in acidic solutions containing chloride and thiosulfate ions by partitioning to the austenite phase and thereby improving the pitting resistance of the austenite; that phase which acts as pit initiation sites in prior art Alloy 75.

Energy dispersive X-ray analysis shows that in X-6 alloy of the present invention containing approximately 2% copper, the chemical composition of the austenite and ferrite phases are as follows:

| | Chemical Composition percent | | |
|---|---|---|---|
| | Cr | Ni | Cu |
| Austenite | 20 | 11 | 3.8 |
| Ferrite | 31 | 4.7 | 0.9 |

Most of the copper in X-6 alloy of the invention is partitioned to the austenite. By partitioning to, and improving the pitting resistance of the less pitting resistant austenite phase the copper addition is beneficial for the entire alloy. The copper addition appears to protect the X-6 alloy from pitting, particularly in acidic chloride-thiosulfate solutions. The finding that the addition of 2% copper improves the pitting resistance of a duplex stainless steel is unexpected and unique.

The alloy of the present invention has improved corrosion-fatigue strength behavior as compared to prior art Alloy 75. The graph shown in FIG. 2 illustrates the improvement in corrosion-fatigue behavior. The curve representing the improved alloy of the present invention is above and to the right of the curve representing the prior art Alloy 75, thus showing that the alloy of the present invention experiences longer service life than prior art Alloy 75 in the aggressive white water shown since a greater number of stress cycles is required to cause failure at any level of maximum stress.

The presence of copper in the alloy of the present invention eliminates the need for an intentional addition of molybdenum to the alloy. Molybdenum can not be added to duplex stainless steel castings which are very slowly control-cooled, because ductility is excessively reduced. In the alloy of the present invention, the presence of molybdenum above 0.5% is harmful because both ductility and pitting resistance are reduced. According to the present invention, molybdenum up to 0.5% is an unintentional addition which is tolerated only to maximize the use of stainless steel scrap available to the foundry and thereby maintain cost-effective production of stainless steel castings.

Figure 3:
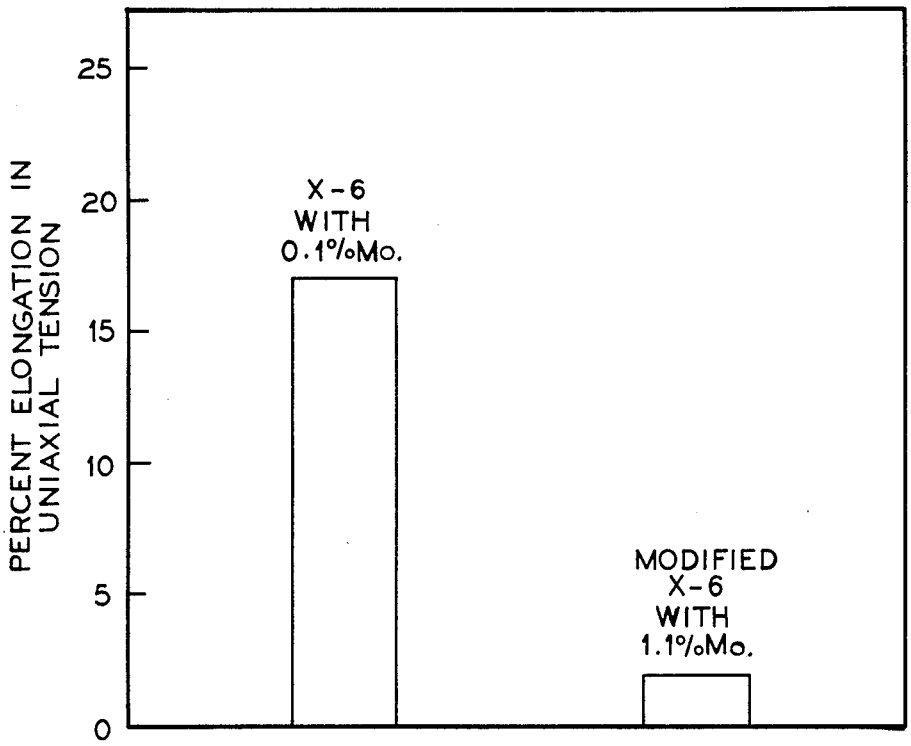
FIG. 3 is a graph showing the effect of molybdenum on the ductility of very slowly control-cooled X-6 alloy, containing nominally 2% Cu.

Comparative ductility tests show the effect of changing the percentage of molybdenum in the alloy of the present invention. FIG. 3 is a graph which shows that an increase in the percent of molybdenum in a very slowly control-cooled modified X-6 alloy causes an unacceptable decrease in ductility of the alloy as measured by the decrease in the percent of elongation in uniaxial tension. The modified X-6 alloy which contained 1.10% molybdenum, a greater weight percentage than the X-6 alloy of the present invention, consisted of (in weight percent); C: 0.02%; Mn: 0.67%; Si: 0.87%; Cr: 24.89%; Ni: 7.33%; Mo: 1.10%; Cu: 2.13%; N: 0.069%; and the balance Fe and unavoidable impurities. The embrittling sigma and chi phases are present in the microstructure of the very slowly control-cooled modified X-6 alloy which contained 1.10% Mo.

Comparative pitting resistance tests show the effect of changing the percentage of molybdenum in the alloy of the present invention. Referring again to the table in FIG. 1, an increase in the percent of molybdenum to 1.10% in the very slowly control-cooled modified X-6 alloy containing 2.1% Cu causes an unacceptable decrease in pitting resistance of the alloy as demonstrated by a zero millivolt breakdown potential value. Again, the alloys of the present invention have excellent pitting resistance as demonstrated by breakdown potentials of +184 and +239 millivolts.

Figure 4:
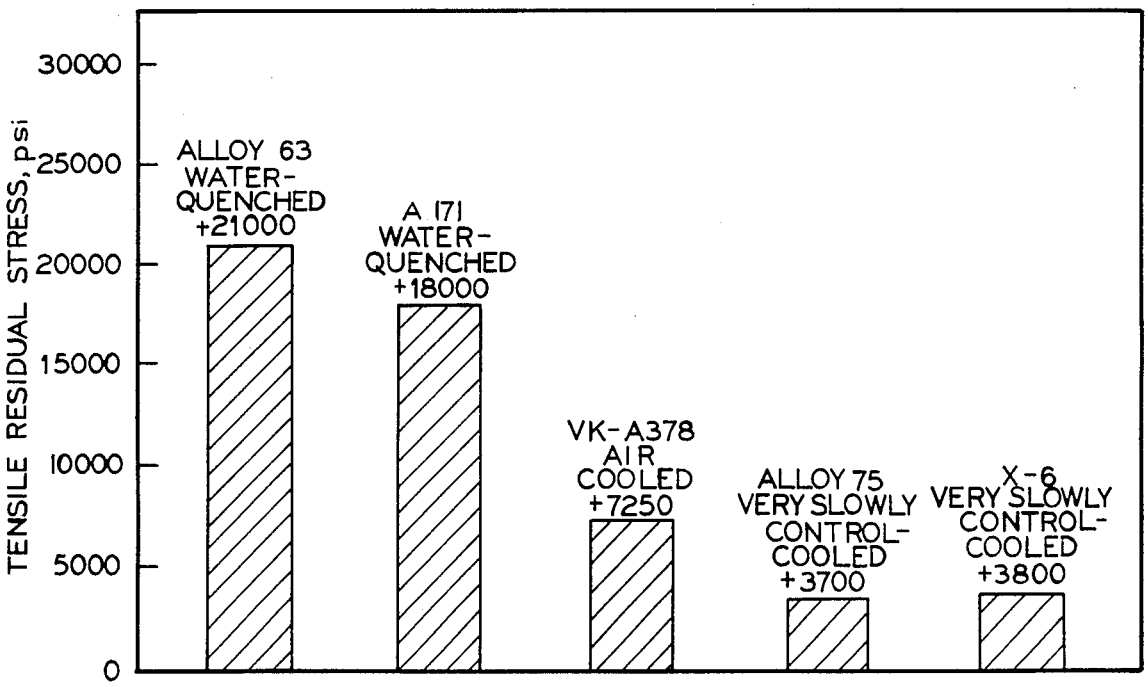
FIG. 4 is a graph showing a comparison of maximum tensile residual stresses of prior art alloys to the X-6 alloy.

Tensile residual stresses have been measured by Sachs method in suction roll shell materials cooled by various methods after being subjected to heat treatment. The graph shown in FIG. 4 compares the tensile residual stresses of the very slowly control-cooled alloy of the present invention to the very slowly control-cooled prior art Alloy 75, an air-cooled Hiraishi et al. alloy identified as VK-A378 and water-quenched prior art materials Alloy 63 and A171. The alloy of the present invention has the same magnitude of minimal tensile residual stress as prior art Alloy 75 and significantly lower tensile residual stress than prior art materials Alloy 63, A171 and the Hiraishi et al. alloy VK-A378.

The quantitative effect of C, Si, Mn, Cr, Ni, Cu, N and Mo upon the ferrite-austenite balance has been evaluated for weldments (Schaeffler diagram) and castings which have been water-quenched after solution annealing at high temperatures (ASTM Specification A800/A800M-84 p. 560). However, the alloy of the present invention when very slowly control-cooled has a greater amount of austenite present than the conventional ferrite-austenite relationships for weldments and castings predict. These conventional evaluations could not be used to determine the elemental weight percentage ranges for the alloy of the present invention to achieve the optimum balance of ferrite and austenite in the microstructure.

Broadly, the compositional range of the alloy of the present invention is as follows:

TABLE I

| Element | Range (Weight Percent) |
|---|---|
| C | 0.10 max. |
| Si | 1.5 max. |
| Mn | 2.0 max. |
| Cr | 23.0–29.0 |
| Ni | 5.0–9.0 |
| Cu | 0.5–3.5 |
| N | 0.2 max. |
| Mo | 1.0 max. |
| Fe | Balance, and unavoidable impurities |

In practice it has been found that the preferred alloy contains the following elements within the cited ranges:

TABLE II

| Element | Range (Weight Percent) |
|---|---|
| C | 0.10 max. |
| Si | 1.5 max. |
| Mn | 2.0 max. |
| Cr | 25.0–27.0 |
| Ni | 5.0–7.5 |
| Cu | 1.5–3.5 |
| N | 0.15 max. |
| Mo | 0.5 max. |
| Fe | Balance, and unavoidable impurities |

For use in, for example, a paper machine shell, the following composition is useful:

TABLE III

| Element | Preferred Composition (Weight Percent) |
|---|---|
| C | 0.02 |
| Si | 0.5 |
| Mn | 0.8 |
| Cr | 25.7 |
| Ni | 6.0 |
| Cu | 2.8 |

TABLE III-continued

| Element | Preferred Composition (Weight Percent) |
|---|---|
| N | 0.07 |
| Mo | 0.5 max. |
| Fe | Balance, and unavoidable impurities |

The copper-bearing stainless steel alloy (X-6), of the present invention has the following attributes that are not matched by any prior art alloy employed for paper machine roll shell applications: (1) the present alloy can be very slowly furnace control-cooled from a high temperature to have very low levels of tensile residual stress; (2) the sigma and other embrittling phases are minimized during slow furnace cooling, (3) the alloy, being a duplex stainless steel, is resistant to sensitization, intergranular attack, or intergranular stress corrosion cracking; (4) the present alloy has very good corrosion-fatigue strength, and (5) the present alloy has excellent resistance to pitting and crevice corrosion in paper-mill acid white water containing chloride and thiosulfate ions. The above combination of properties is unexpected and is not believed obtainable in other duplex stainless steels.

FIG. 5 is a table containing the corresponding chemistry and mechanical properties data comparing the X-6 alloy to prior art CF-3M and three heats of Alloy 75. The alloys were evaluated electrochemically for pitting resistance in a simulated white water media described as follows:

1. Solution "A" Chemistry

| Chemical Compound | Ionic Species Concentration |
|---|---|
| 660 ppm NaCl | 400 ppm $Cl^-$ (Chloride) |
| 750 ppm $Na_2SO_4$ | 507 ppm $SO_4^=$ (Sulfate) |
| 15 ppm $Na_2S_2O_3$ | 11 ppm $S_2O_3^=$ (Thiosulfate) |

(a) pH of solution adjusted to 4.1 with sulfuric acid.
(b) Solution temperature during test = 125–130° F.

The extent of pitting resistance, based on electrochemical cyclic polarization evaluations, as described in ASTM G61-78, is best shown by the potential corresponding to passive film breakdown. The larger the positive value the better the pitting resistance.

1A. Pitting Resistance Test Results-Solution A

| Alloy | Heat | Run | Breakdown Potential Millivolts vs. SCE |
|---|---|---|---|
| X-6 | 1232-3 | 1 | +210 |
| | | 2 | +190 |
| CF-3M | 168375 | 1 | +100 |
| | | 2 | +120 |
| Alloy 75 | 167095 | 1 | −240 |
| | | 2 | * |
| Alloy 75 | 161353 | 1 | ∅ |
| | | 2 | +10 |
| Alloy 75 | 161255 | 1 | +50 |
| | | 2 | +50 |

2. Solution "B" Chemistry

| Chemical Compound | Ionic Species Concentration |
|---|---|
| 660 ppm NaCl | 400 ppm $Cl^-$ (Chloride) |
| 2958 ppm $Na_2SO_4$ | 2000 ppm $SO_4$ = (Sulfate) |
| 82 ppm $Na_2S_2O_3$ | 58 ppm $S_2O_3$ = (Thiosulfate) |

Pitting Resistance Test Results-Solution B

| Alloy | Heat | Run # | Breakdown Potential Millivolts vs. SCE |
|---|---|---|---|
| X-6 | 1232-3 | 1 | +800 |
| | | 2 | +800 |

-continued

| | | | |
|---|---|---|---|
| Alloy 75 | 167095 | 1 | −240 |
| | | 2 | −245 |

*Specimen actively corroded and, therefore, no breakdown potential could be established.
(a) pH adjusted to 4.9 with sulfuric acid
(b) Solution temperature during test = 125° F.

Figure 8:
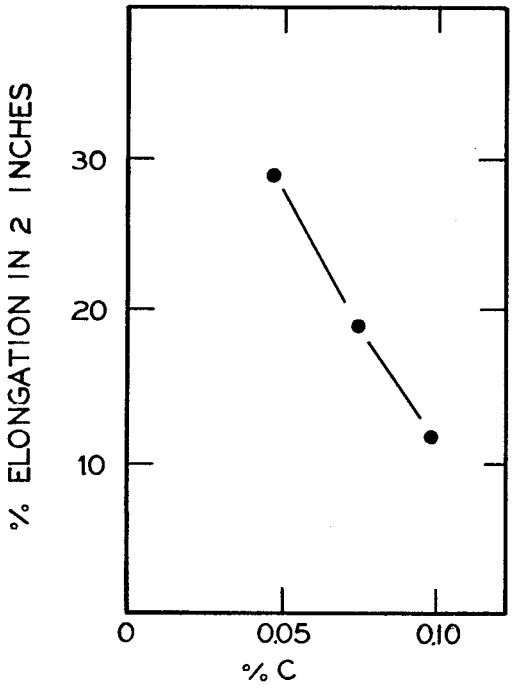
FIGS. 8, 9 and 10 are graphs showing the effect of increasing the levels of carbon, manganese, and silicon, respectively, on the ductility of the X-6 alloy.
Figure 9:
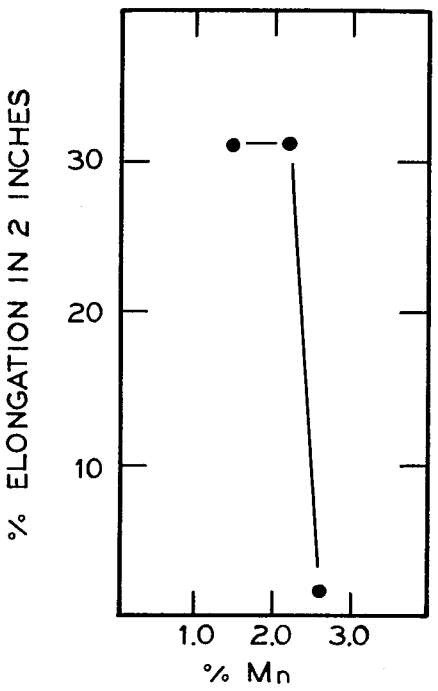
Figure 10:
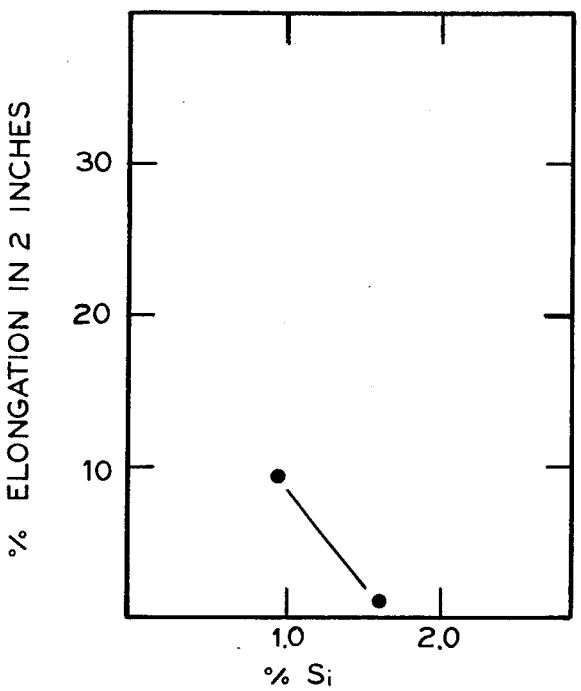

The data provided in FIGS. 6 and 7 show the chemical composition and mechanical properties for a series of modified Alloy X-6 castings. FIG. 6 shows the modifications made to the chemistry of the X-6 alloy of the present invention regarding silicon, manganese and carbon. All metals listed were very slowly control-cooled in a furnace prior to the determination of their respective mechanical properties. FIG. 7 lists the mechanical properties results of each variable in FIG. 6. Note that simultaneously increasing all three of the elements to higher levels produces a metal with unacceptable ductility (Item 8, FIG. 7). Also, increasing only silicon to 1.59% (Item 2, FIG. 7) or only manganese to 2.59% (Item 5, FIG. 7) produces a metal with unacceptable ductility. FIGS. 8, 9, and 10 are graphs which show what happens to ductility when the level of carbon, manganese or silicon in Alloy X-6 is increased: increasing carbon up to 0.099% does not adversely affect ductility; also, increasing manganese up to 2.0% or silicon to 1.5% does not adversely affect ductility. The X-6 alloy of the present invention can contain increased levels of carbon to 0.10%, the manganese level to 2.0%, and silicon to 1.50% while still providing an improved, copper-bearing stainless steel alloy which can be very slowly furnace control-cooled from a high temperature to have very low levels of tensile residual stress. The sigma and other embrittling phases are minimized during the slow furnace cooling. The present alloy is less susceptible than fully austenitic alloys to sensitization, intergranular attack, or intergranular stress corrosion. The present alloy has very good corrosion-fatigue strength. At the same time, the present alloy has excellent resistance to pitting and crevice corrosion in acidic solutions containing chloride and thiosulfate ions.

The above detailed description of the invention is given only for the sake of explanation. Various modifications and substitutions other than those cited, can be made without departing from the scope of the invention as defined in the following claims.

What we claim:

1. A highly pitting resistant ferritic-austenitic duplex cast stainless steel alloy which has been very slowly control-cooled such that harmful tensile residual stresses are minimized while retaining excellent ductility and corrosion resistance and consists of, in weight percentage; C: 0.10% and below; Si: 1.5% and below; Mn: 2.0% and below; Cr: 25.0% to 27.0%; Ni: 5.0% to 7.5%; Cu: 1.5% to 3.5%; N: 0.15% and below; Mo: 0.5% and below; and the remaining portion Fe and unavoidable impurities.

2. A highly pitting resistant ferritic-austenitic duplex cast stainless steel alloy which has been very slowly control-cooled such that harmful tensile residual stresses are minimized while retaining excellent ductility and corrosion resistance and consists of, in weight percentages, C: 0.02%; Si: 0.5%; Mn: 0.8%; Cr: 25.7%; Ni: 6.0%; Cu: 2.8%; N: 0.07%; Mo: 0.5% and below; and the remaining portion Fe and unavoidable impurities.

* * * * *